US007027012B2

(12) United States Patent
Kuroki et al.

(10) Patent No.: US 7,027,012 B2
(45) Date of Patent: Apr. 11, 2006

(54) SURFACE DISCHARGE TYPE PLASMA PANEL DIVIDED INTO A PLURALITY OF SUB-SCREENS

(75) Inventors: Seiki Kuroki, Kawasaki (JP); Nguyen Thanh Nhan, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 300 days.

(21) Appl. No.: 10/453,488

(22) Filed: Jun. 4, 2003

(65) Prior Publication Data

US 2004/0251829 A1 Dec. 16, 2004

Related U.S. Application Data

(62) Division of application No. 09/951,749, filed on Sep. 14, 2001, now Pat. No. Re. 38,819.

(30) Foreign Application Priority Data

Apr. 3, 1996 (JP) ..... 8-081421

(51) Int. Cl.
*G09G 3/20* (2006.01)
*G09G 3/28* (2006.01)

(52) U.S. Cl. ..... 345/60; 345/55; 345/66; 345/67; 345/68

(58) Field of Classification Search ..... 345/37–44, 345/55, 60–68; 313/582–587; 315/169.1–169.4
See application file for complete search history.

(56) References Cited

U.S. PATENT DOCUMENTS 4,320,418 A 3/1982 Pavliscak ..... 358/240
4,426,646 A * 1/1984 Yamaguchi et al. ..... 345/62
5,914,563 A 6/1999 Lee et al. ..... 313/585
6,259,494 B1 * 7/2001 Kawai et al. ..... 349/39
6,373,452 B1 * 4/2002 Ishii et al. ..... 345/67
6,414,656 B1 * 7/2002 Hong ..... 345/60

OTHER PUBLICATIONS

Patent Abstracts of Japan of JP 11-065486 published Mar. 5, 1999.
Patent Abstracts of Japan of JP 2000-231881 published Aug. 22, 2000.

* cited by examiner

*Primary Examiner*—Vijay Shankar
(74) *Attorney, Agent, or Firm*—Staas & Halsey LLP

(57) ABSTRACT

A surface-discharge type PDP includes plural electrode pairs formed of first and second sustain electrodes arranged on a first substrate. Each pair extends along a line direction, and the first and second sustain electrodes are in parallel and adjacent to each other. Plural address electrodes arranged on a second substrate opposing the first substrate via a discharge space, each extending along a row direction, a matrix corresponding to a screen to be displayed is formed with the main electrodes and address electrodes, the address electrodes are orthogonal to the main electrodes, each of the address electrode is divided into, for example two partial address electrodes separated from each other by a border line located between adjacent main electrode pairs, whereby the screen is divided into two partial screens, wherein a first clearance between the partial address electrodes is substantially larger than a second clearance between main electrode pair adjacent across the border line. The arrangement order of the first and second sustain electrodes may preferably be such that first sustain electrodes of the first and second partial screens face each other via the border line, and the partial address electrodes may not cross over the first sustain electrodes nearest to the border line.

24 Claims, 7 Drawing Sheets

PRIOR ART

SURFACE DISCHARGE TYPE PLASMA PANEL DIVIDED INTO A PLURALITY OF SUB-SCREENS

This application is a divisional of application Ser. No. 09/951,749, filed Sep. 14, 2001, now U.S. Pat. No. Re. 38,819, which is reissue of U.S. Pat. No. 5,952,783 issued Sep. 12, 1999.

BACKGROUND OF THE INVENTION

1. Field of the Invention

This invention relates to an AC type plasma display panel, referred to hereinafter as a PDP, of matrix formation, particularly to a PDP having a screen which is divided into a plurality of sub-screens.

2. Description of the Related Arts

Figure 1:
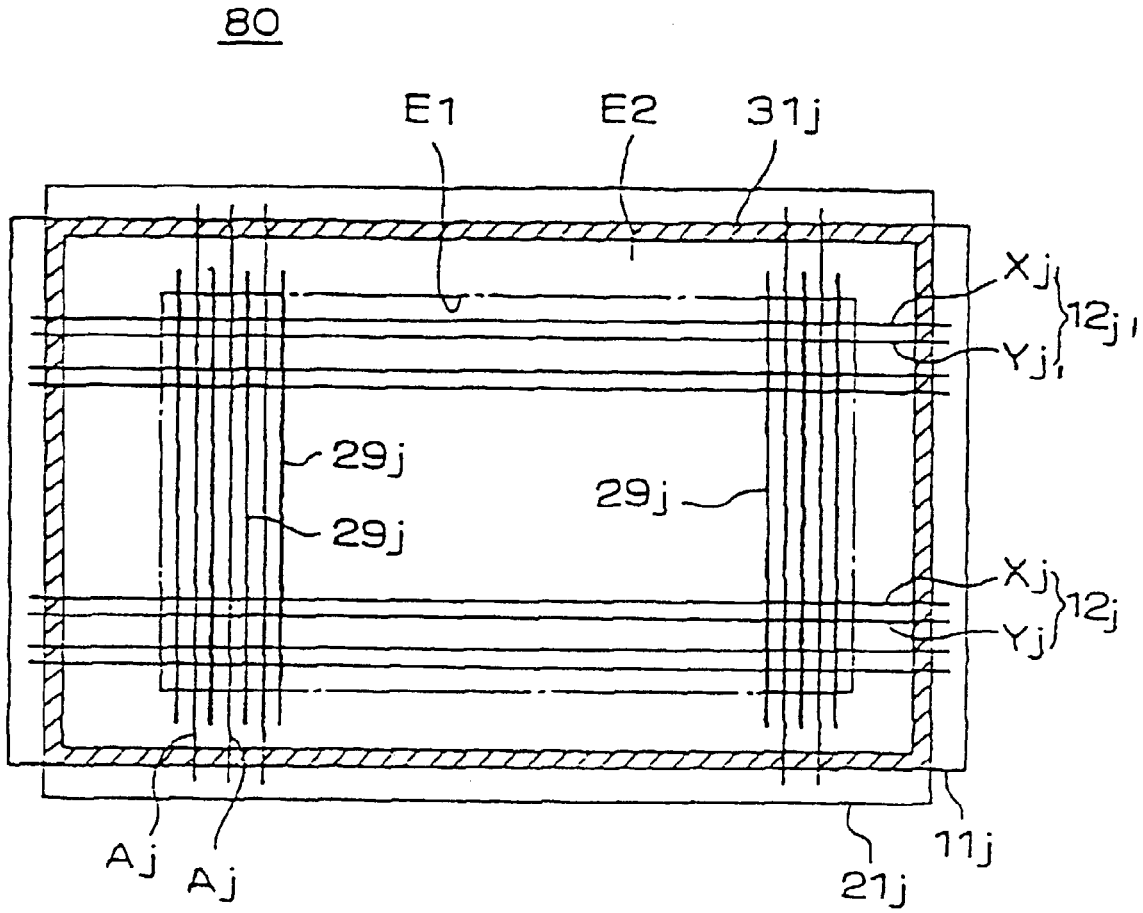
PRIOR ART Fig. 1
Figure 2:
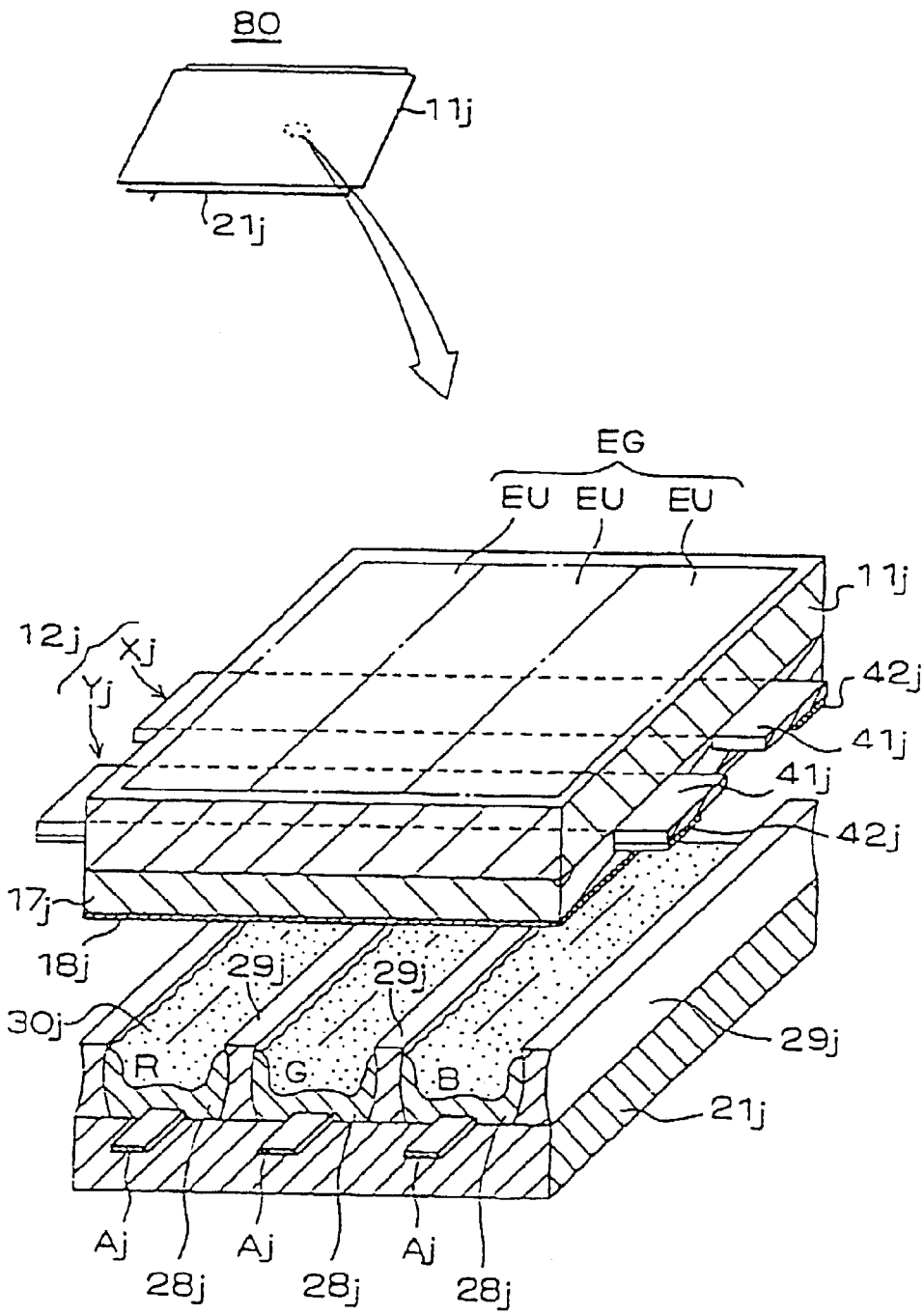
PRIOR ART Fig. 2

A prior art surface discharge type PDP is hereinafter described with reference to FIG. 1 schematically illustrating a plan view of the electrode configuration, and FIG. 2 schematically illustrating a decomposition perspective view of the internal structure.

Prior art PDP 80 includes a plurality of electrode pairs 12*j* of first and second sustain electrodes Xj & Yj in parallel with each other and extending straight, both of which may be called main electrodes, and a plurality of address electrodes Aj in straight and orthogonal to first and second sustain electrodes Xj & Yj. Each electrode pair 12*j* corresponds to a single line of the matrix formation, and each address electrode Aj corresponds to a single row. That is, an area E1 where the sustain electrodes and the address electrodes intersect each other is a displaying area, referred to hereinafter as a screen. In the periphery of the screen is provided a non-lighting area E2 of a predetermined width in order to be free from an effect of a gas degased from sealant to seal the two glass substrates 11*j* and 21*j*.

As shown in FIG. 2, a prior art PDP 80 is constituted with a front glass substrate 11*j*, first and second sustain electrodes Xj & Yj, a dielectric layer 17*j* for an AC drive, a protection layer 18*j*, a back glass substrate 21*j*, address electrodes Aj, separator walls 29*j* and fluorescent material layers 28*j* for a full-color display. A discharge space 30*j* therein is divided into each subpixel EU along a line direction, that is, a direction along which sustain electrodes Xj & Yj extend, by separator wall 29*j*, which also determines a gap between the substrates.

First and second sustain electrodes Xj & Yj are arranged on an inner surface of back glass substrate 21*j*, and each of which is formed of a wide transparent electrically conductive film 41*j* and a metal film 42*j* thereon for securing a good electrical conductivity. Transparent electrically conductive film 41*j* is patterned belt-like wider than metal film 42*j* so that a surface discharge may expand.

Fluorescent material layer 28*j* is coated between each separator wall 29*j* on back glass substrate 21*j* in order to reduce an ion bombardment, and emits a light by a local excitation of ultraviolet rays generated in the surface discharge. Among the visible radiations emitted from the surface of fluorescent layer 28*j*, i.e. the surface to face the discharge space, the light which can penetrate through glass substrate 11*j* becomes a display light.

Pixel, i.e. picture element, EG of the screen matrix includes three sub-pixels EU which line up along the line direction, where the lighting colors of the three sub-pixels EU are mutually different as denoted with R, G and B, so that each color to be displayed of a single pixel is determined by the combination of the basic R, G and B. The pattern arrangement of separator walls 29*j* is so-called a stripe pattern, where the part which corresponds to each row in discharge space 30 extends in the row direction continuously to cross over all the lines. The emitting color of sub-pixels EU in each row is identical.

Second sustain electrode Yj of the electrode pair 12*j* and address electrode Aj are used for selecting, i.e. addressing, a pixel EU to light or not to light. That is, a screen scanning is performed sequentially line by line by applying a scan pulse onto sequential one of n second sustain electrodes Yj, where n indicates the quantity of the lines, and a predetermined electrically charged state is formed in the selected cell of each row by an opposing discharge, i.e. an address discharge, generated between the second sustain electrode Yj and an address electrode Aj selected in accordance with the contents to be displayed. After the addressing operation is thus performed, upon an application of the sustain pulses of a predetermined peak value alternately onto first and second sustain electrodes Xj & Yj a surface discharge, i.e. a sustain discharge, takes place in the cell in which wall charges of a predetermined amount ;remaining at the end of the addressing operation.

In performing the addressing operation according to the above-described line-scanning, if the quantity of the lines are increased so as to meet a requirement to enhance the screen size or to accomplish a higher resolution, the period required for the addressing operation becomes longer. However, a single frame, that is a period for displaying a single picture, is unalterable. Accordingly, the longer the addressing period becomes, the shorter the time length allocatable to the sustain period becomes, resulting in inadequate brightness of the display. Moreover, the gradation display by dividing the frame become difficult.

Therefore, it has been measured to divide screen E1 along the row direction, that is, along upper and lower direction of FIG. 1 into plural partial screens in each of which the addressing operation is concurrently performed. Then, address electrodes Aj are divided into each partial screen too. Dividing of the display screen into two partial screens allows the period required for the addressing operation to reduce to a half.

However, in dividing all the sustain electrode pairs simply into two partial screens, there is a problem in that an erroneous discharge may take place across the border line where the second sustain electrode Y of the first sub-screen E11 faces the first sustain electrodes of the next line of the next partial screen E12.

This problem is hereinafter described in detail with reference to FIGS. 3A and 3B. FIG. 3B schematically illustrates a cross-sectional view of the electrode structure cut along b-b of FIG. 3A. Display screen E1 is divided into two partial screens E11 and E12. In each of partial screens E11 and E12 are provided partial address electrodes A1*j* and A2*j*, respectively, symmetric with respect to the border line DL. However, in practically sealing the two glass substrates the symmetry may be somewhat deviated. Clearance Dj between two partial address electrodes A1*j* and A2*j* respectively of first and second partial screens E11 and E12 is chosen narrower than the electrode clearance d between two lines. This is in order to keep properly the positional relation between second sustain electrode Y and partial address electrode A, even in the case where the symmetry is deteriorated due to a miss-alignment of the facing two glass substrates during the sealing operation, that is, the end of first partial address electrode A1 can always cross over the last second sustain electrode Yn, so that an address discharge can certainly take place between first partial address electrode A1 and the last second sustain electrode Yn of the first partial screen.

However, in the case where addressing operation is performed concurrently for two partial screens E11 and E12, when addressing discharge is generated only in one of the partial screens there is generated a potential different between two partial address electrodes A1*jn* and A2*jn*. Accordingly, the narrower the clearance Dj is, the more likely an erroneous discharge, or an interference, generates between two partial address electrodes A1*j* and A2*j* or between a second sustain electrode Yjn and a second partial address electrode A2*jn*+1 of second partial screen.

SUMMARY OF THE INVENTION

It is a general object of the invention to prevent an erroneous discharge, i.e. an interference, across a border line of the divided screens in attempting a high speed addressing operation by dividing a screen.

A surface-discharge type plasma display panel includes: a plurality of main electrode pairs formed of first and second sustain electrodes arranged upon a first substrate, each extending along a line direction, the first and second sustain electrodes are in parallel and adjacent to each other. The display panel further includes a plurality of address electrodes arranged upon a second substrate opposing the first substrate via a discharge space, each extending along a row direction, a matrix corresponding to a screen to be displayed is formed with the main electrodes and address electrodes, the address electrodes are orthogonal to the main electrodes, each of the address electrode is divided into, for example two partial address electrodes separated from each other by a border line located between adjacent main electrode pairs, whereby the screen is divided into two partial screens, wherein a first clearance between the partial address electrodes is substantially larger than a second clearance between main electrode pair adjacent across the border line. The arrangement order of the first and second sustain electrodes may preferably be such that first sustain electrodes of the first and second partial screens face each other via the border line, and the partial address electrodes may not cross over the first sustain electrodes nearest may not cross over the first sustain electrodes nearest to the border line.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

Figure 3A:
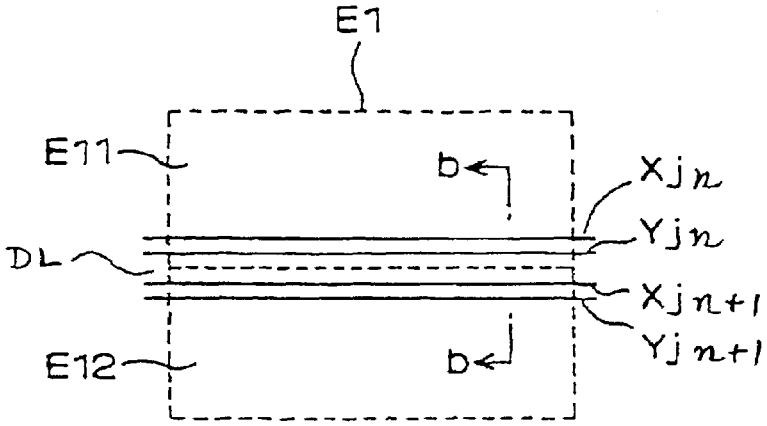
Figure 3B:
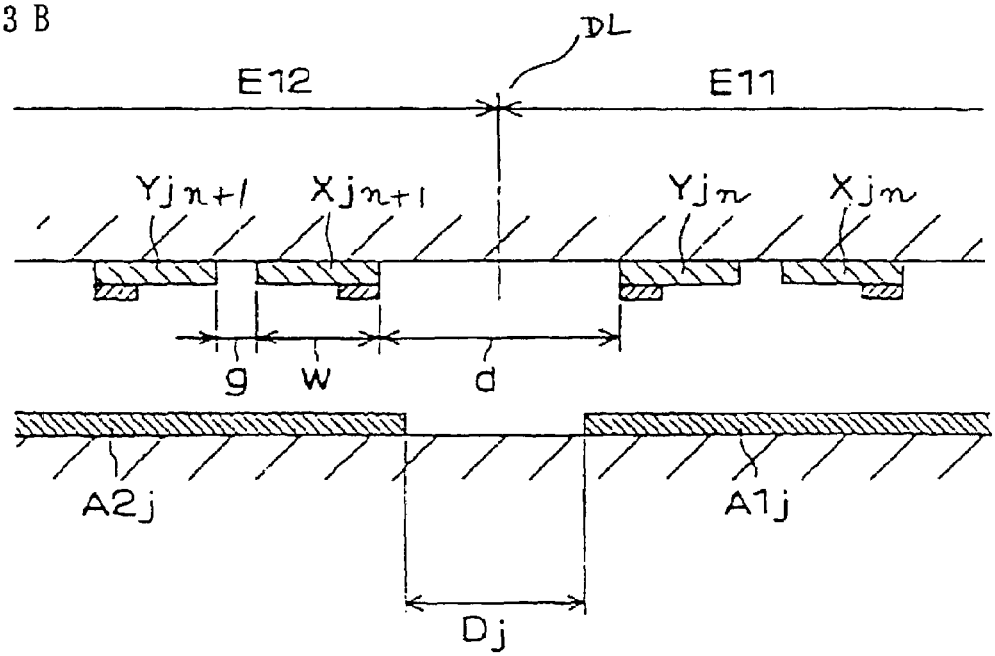
Figure 4:
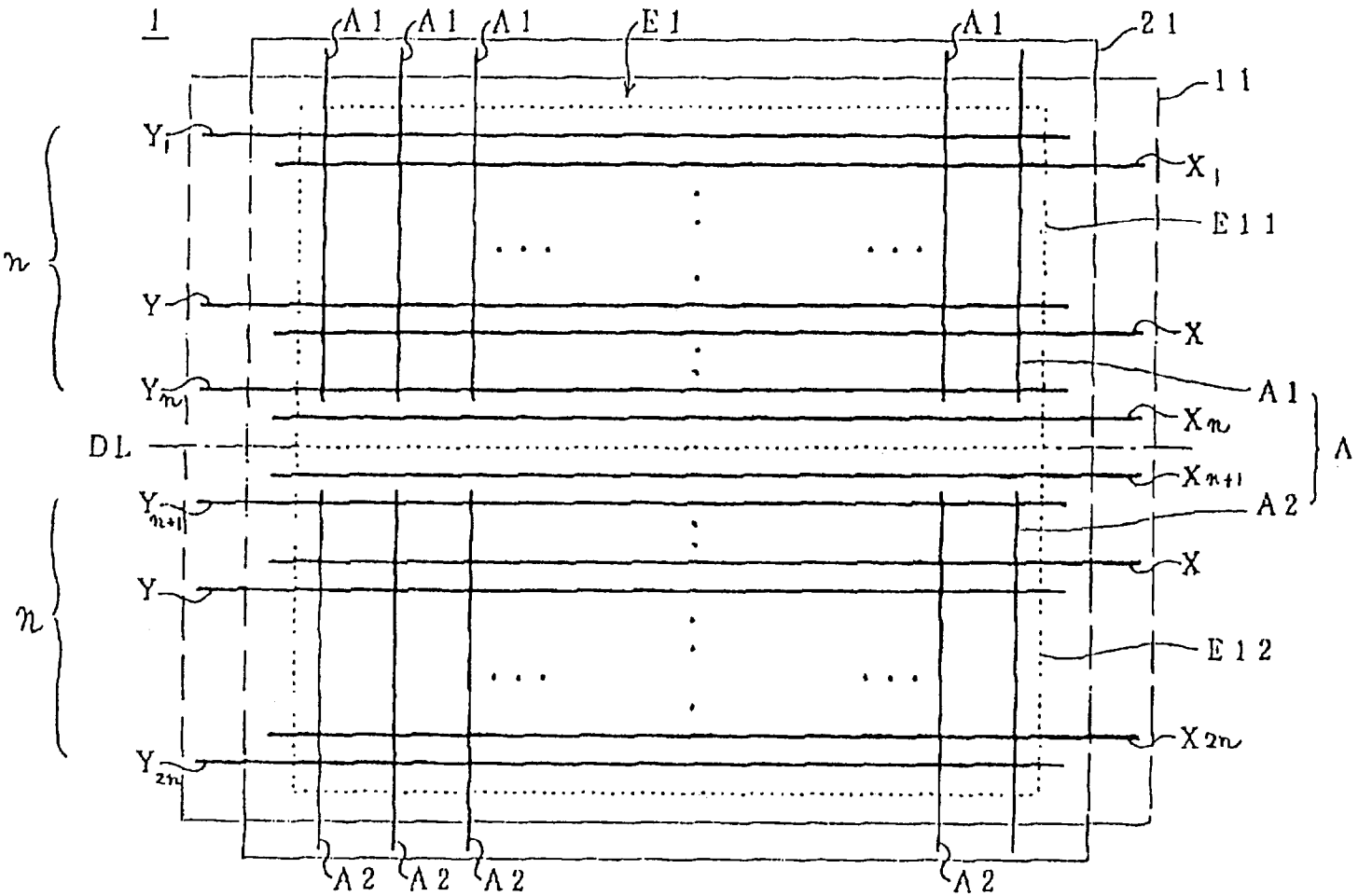
Figure 5:
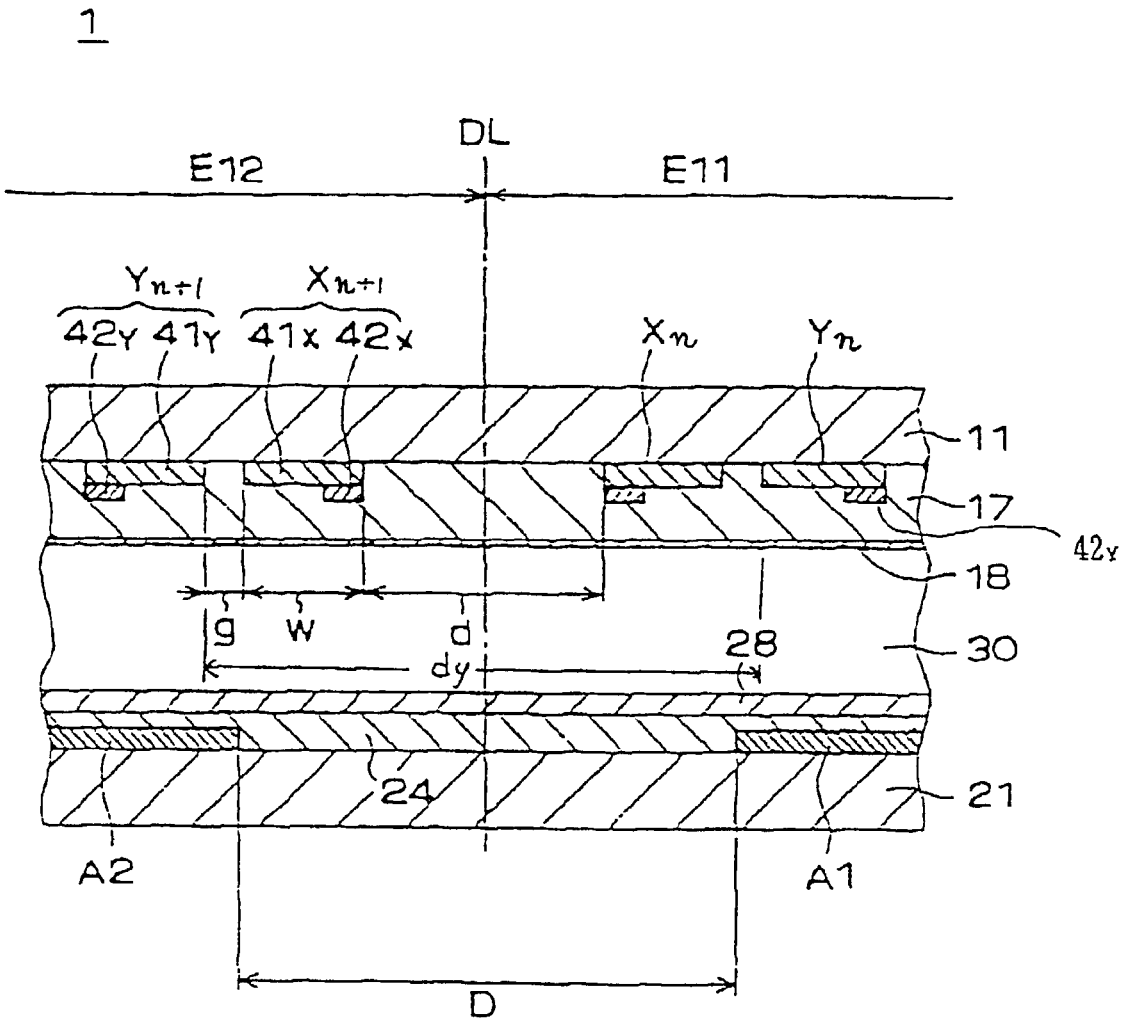
Figure 6:
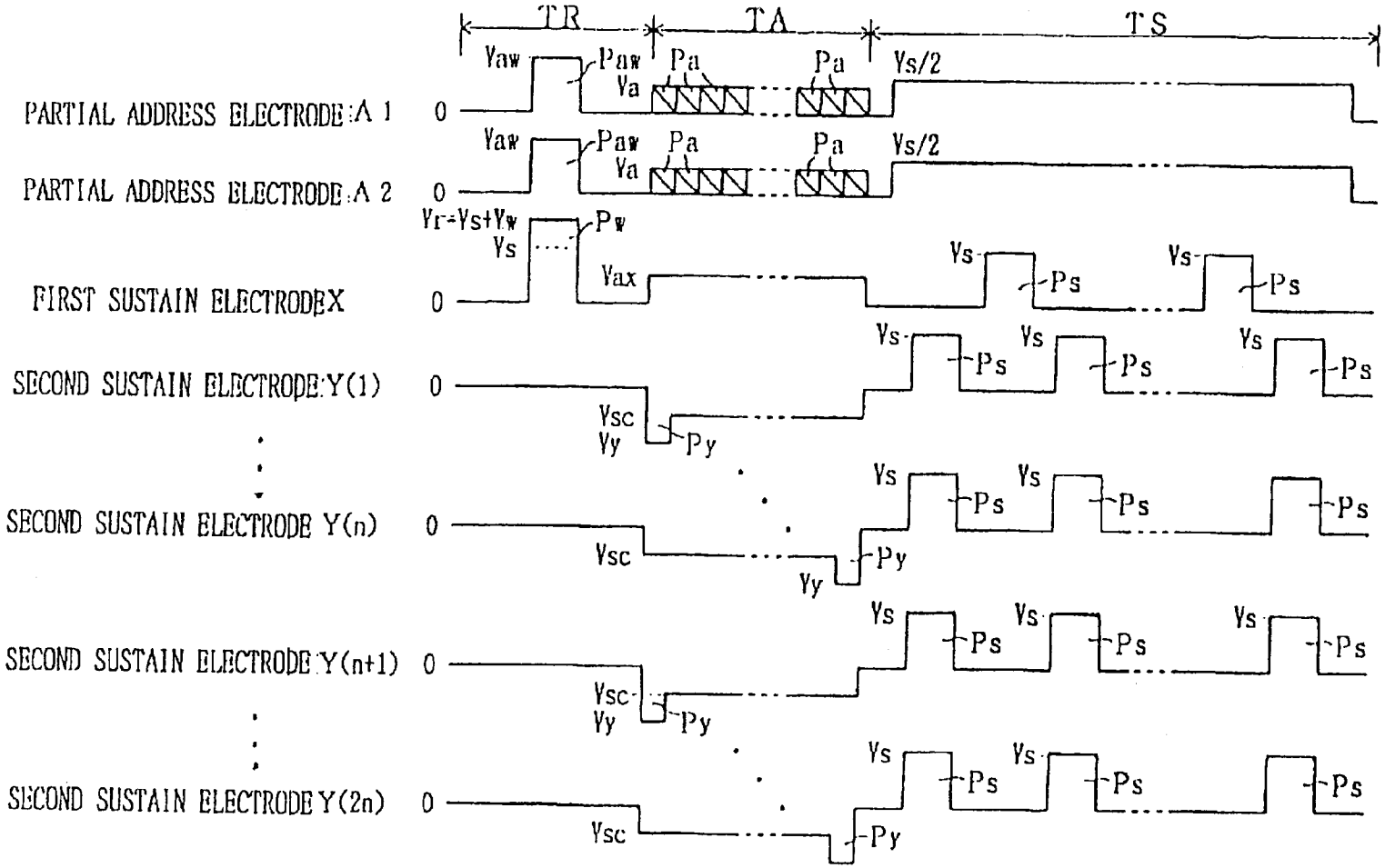
Figure 7:
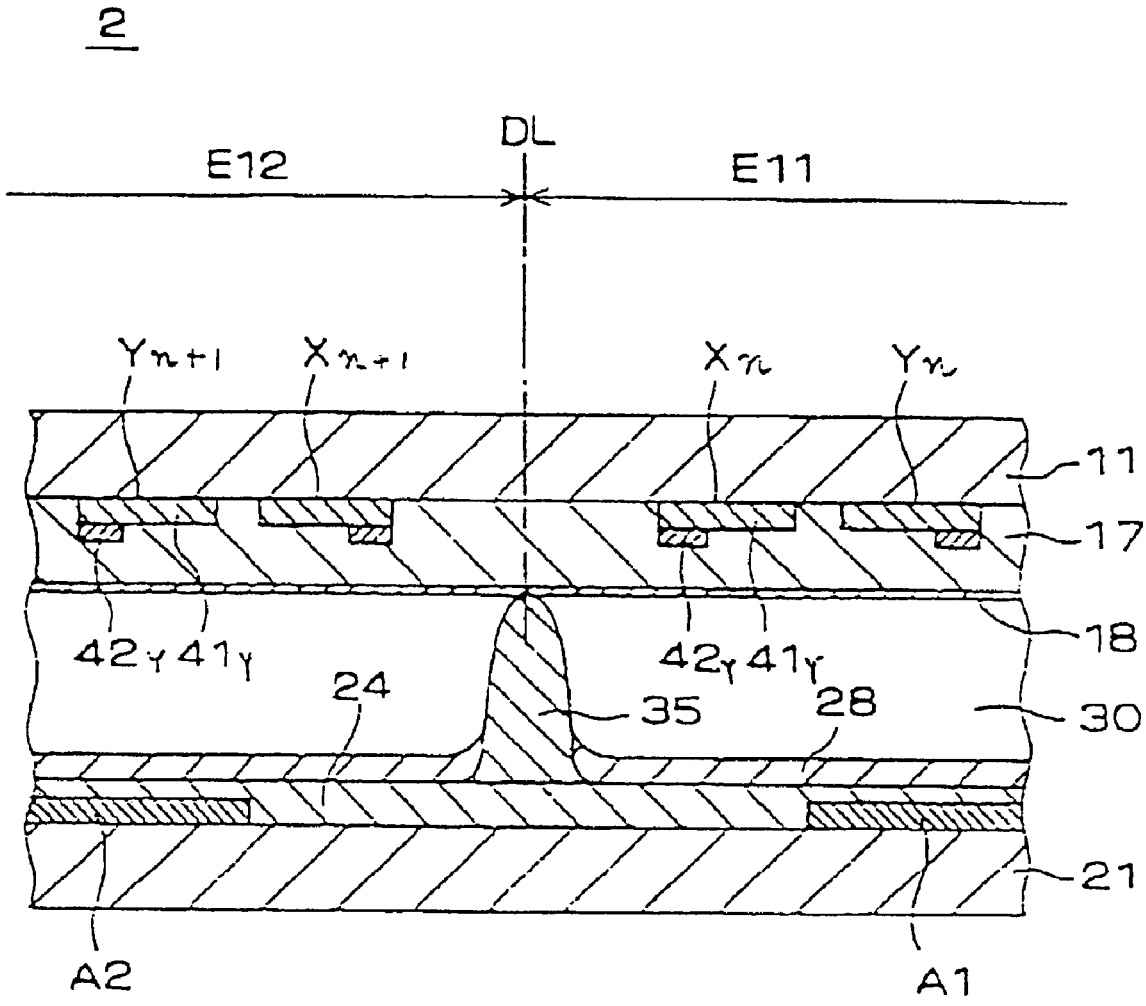

FIG. 1 schematically illustrates an electrode configuration of a prior art PDP;

FIG. 2 schematically illustrates a decomposition perspective view of the prior art PDP;

FIGS. 3A and 3B schematically illustrate an electrode configuration and a cross-sectional view of the electrode structure of the prior art PDP having two partial screens;

FIG. 4 schematically illustrates an electrode configuration of the electrode structure of a first preferred embodiment of the present invention, having two partial screens;

FIG. 5 schematically illustrates a cross-sectional view of the electrode structure of the first preferred embodiment of the present invention;

FIG. 6 schematically illustrates a timing chart of voltages applied to the PDP of the present invention; and FIG. 7 schematically illustrates a cross-sectional view of the electrode structure of the second preferred embodiment of the present invention.

DESCRIPTION OF THE PREFERRED EMBODIMENT

A preferred embodiment of the present invention is hereinafter described with reference to FIG. 4 schematically illustrating electrode configuration of a PDP, and FIG. 5 schematically illustrates a cross-sectional cut view of a PDP of the present invention.

PDP 4 is a surface discharge type PDP in which a single line is formed of a pair of first and second sustain electrodes X and Y, each in parallel and straight. The screen E1 is divided into two partial screens, that is first partial screen E11 and a second partial screen E12, in the row direction. The quantity of lines of the entire screen E1 is 2*n*, where the quantity of lines of each partial screen E11 and E12 is n. On each row of first partial screen E11 is provided with a first partial address electrode A1, and on each row of second partial screen E12 is provided with a second partial address electrode A1. A single pair of first and second address electrodes A1 and A2 aligned along a single row forms a single address electrode A which corresponds to the single row. First address electrodes A1 are led out to a first side at first ends of the address electrodes, and second address electrodes A2 are led out to a second side, opposite from the first side, at second ends of the address electrodes. First sustain electrodes X are led out to a first side of first glass substrate 11 at first ends of the lines, and second sustain electrodes Y are led out to a second side opposite from the first side.

Totally 2*n* first sustain electrodes X and totally 2*n* second sustain electrodes Y are arranged along the row direction symmetrically with respect to the border line DL of first partial screen E11 and second partial screen E12 so that Xn-th and Xn+1 the first sustain electrodes Xn and Xn+1 are facing each other across the border line DL. In other words, in the first partial screen E11 are alternately arranged second and first sustain electrodes Y and X from the top of the first partial screen to the border line in the order of Y1, X1 . . . Xn−1, Yn−1, Xn; while in the second partial screen E12 are alternately arranged first and second sustain electrodes X and Y from the border line DL to the bottom of the second partial screen in the order of Xn+1, Yn+1 . . . X2*n* and Y2*n*, where the order is opposite to that in the first partial screen E1. Each of first address electrodes A1 in first partial screen E11 crosses over all of n second sustain electrodes Y1-Yn and all of (n−1), first sustain electrodes X1-Xn−1 excluding the last one Xn adjacent to the border line DL. In the similar way, each of second address electrodes A2 in second partial screen E12 cross over all of n second sustain electrodes Yn+1-Y2*n* and all of (n−1) first sustain electrodes Xn+2−X2*n* excluding the first one Xn+1 adjacent to the border line DL.

First and second sustain electrodes X and Y are arranged on an inner surface of front glass substrate 11, and respectively formed of a transparent electrically conductive film 41 and a metal film 42 thereon as shown in FIG. 5. Upon a dielectric layer 17 covering first and second sustain electrodes X and Y is vapor-deposited a protection layer 18 formed of MgO, magnesium oxide. First and second partial address electrodes A1 and A2 are arranged on an inner surface of back glass substrate 21 and is coated with an insulating layer 24. Upon insulating layer 24 are provided separator walls, which is not shown in the figure, and a fluorescent material layer 28. Each separator wall separates discharge space 30 into each subpixel along the line direction, and also acts to keep the height of the discharge space 30 uniform. The separator wall structure and the layout pattern of the fluorescent material layer of PDP 1 are identical to those of the prior art structure shown in FIG. 3.

In performing the display, the addressing operation is first carried out by generating a discharge in a direction along the thickness of the glass substrates, referred to hereinafter as an opposing discharge, between second sustain electrode Y and first partial address electrode A1 in first partial screen E11, and between second sustain electrode Y2 and second partial address electrode A in second partial screen E12.

A clearance D between first partial address electrode A1 of first partial screen E11 and second partial address electrode A2 of second partial screen E12 is chosen longer than the sum of twice of the width w of first sustain electrode X and a clearance d, typically 430.mu.m, between two first sustain electrodes Xn & Xn+1 across the border line DL, and shorter than a clearance dy between two nearest second sustain electrodes Yn & Yn+1 across the border line DL, that is $2w+d<D<2w+d+2g=dy$, where g indicates a clearance between the paired first and second sustain electrodes X and Y. These dimensional conditions are such that clearance D between address electrodes A1 & A2, respectively of the first and second partial screens, allow the address electrodes to cover second sustain electrodes Yn and Yn+1 to which the address discharge has to certainly performed, however, not to cross over the first sustain electrodes Xn and Xn+1 to which no discharge be generated from the address electrodes A. Thus, the clearance D between address electrodes A1 & A2 is adequately wide to keep address electrode An & An+1 away from the second sustain electrode Yn+1 & Yn of the opposite partial screen. Therefore, in PDP of the present invention more hardly takes place the erroneous discharge occurs less frequently than in the prior art PDP, that is, there is no interference between two partial screens.

A typical driving method of PDP 1 is hereinafter described. FIG. 6 schematically illustrates waveforms of the applied voltages. A single field corresponds to a single frame. However, in reproducing a screen, i.e. a scene, scanned by an interface format, such as of a television, two fields are used in displaying a single screen.

In order to achieve a gradation display, a single field is divided into a plurality, for example six to eight, a sub-fields. Each sub-field contains a reset period TR, an address period TA and a sustain period TS. Quantity of lightings in the sustain period TS is predetermined so as to appropriately weight the brightness. Accordingly, each sub-field corresponds to a display period of a certain gradation level.

Reset period TR is such that in order to be free from an influence of the previous lighting state the wall charges in the first and second partial screen E11 and E12 are all erased; i.e. an entire erasing is performed. A writing pulse PW is applied to all of first sustain electrodes X, and concurrently a pulse Paw having the same polarity as the first sustain electrodes X is applied to all of first and second partial address electrodes A1 & A2. In response to the rise of the writing pulse strong surface discharges take place at all the lines so as to once accumulate the wall charges on dielectric layer 17. However, in response to the fall of the writing pulse a so-called self-discharge by the wall discharges takes place whereby the wall charges on the dielectric layer 17 disappear. The pulse Paw is in order to suppress a discharge between the address electrodes A and the first sustain electrodes X, accordingly, to suppress an accumulation of wall charges on the back glass substrate.

Address period TA is a period during which a line-sequential addressing operation is performed. First sustain electrodes X are applied with a potential Vax positive with respect to the earth potential, for example 50V. All the second sustain electrodes Y are applied with a negative potential Vsc with respect to the earth potential, for instance −70V.

Under such a condition, each line in each partial screen E11 & E12 is sequentially selected one by one, for example, beginning from each top line by applying thereto a scanning pulse Py of the negative polarity, for instance, −170V.

Concurrent to the selection of the line, an address pulse Pa of positive polarity having a peak value Va, for instance, 60V, is applied to specific first & second partial address electrode A1 & A2, associated with a display cell to be lit, respectively. At the display cell on the selected line, and to which address pulse Pa is applied, an address discharge takes place between second sustain electrode Y and first and second partial address electrodes A1 or A2. No discharge takes place between first sustain electrode X and first or second partial address electrodes A1 or A2 because thus selected first sustain electrode X is applied with a potential Vax having the polarity of the address pulse Pa so as to keep the potential difference between the first sustain electrode X and address electrode A lower than the discharge firing voltage therebetween.

In consideration of avoiding an interference of the discharges between the lines it is preferable to deviate the timing to select the top line, the n+1 th line, of the second screen E12 from the moment to select the last line, the n-th line, of the first screen E11.

Sustain period TS is a period during which the quantity of times for a cell to light set in the addressing period is reproduced so as to achieve thus set brightness gradation level.

In order to prevent an erroneous opposing discharge, i.e. a discharge across the discharge space, all address electrodes A are applied with a positive potential of, for instance, +Vs/2, and at the beginning a sustain pulse Ps of positive polarity having a peak value Vs, for example 195 V, which is higher than the surface discharge firing voltage between first and second sustain electrodes X and Y in consideration of the effect of the wall charges is applied to all second sustain electrodes Y.

Subsequently, the sustain pulse Ps is applied alternately onto first sustain electrodes X and second sustain electrodes Y. Upon each application of sustain pulse Ps, the surface discharges take place in the cells that have accumulated the wall charge during address period TA.

A second preferred embodiment of the present invention is hereinafter described with reference to FIG. 7 schematically illustrating a cross-sectional cut view of a PDP 2 wherein functional elements having the same function as FIG. 5 are denoted with the same numerals.

Feature of the structure of PDP 2 is in that a line separator wall 35 is provided on border line DL of first partial screen E11 and second partial screen E12. Line separator wall 35 extends as long as the entire length of the lines of the display screen E1, and divides discharge space 30 into two along the row direction. Line separator wall 35 prevents the interference of the discharges between first partial screen E11 and second partial screen E12. Line separator wall 35 is fabricated concurrently at the time when separator wall 29, to determine each sub-pixel shown in FIG. 2, is fabricated. Line separator wall 35 has not always to contact the inner surface of front glass substrate. That is, even if there is a gap between line separator wall 35 and the inner surface of front the front glass substrate, the interference is suppressed. This is because a surface distance between first partial address electrodes A1 and second partial address electrodes A2 is increased by the provision of line separator wall 35, that is, the electrode distance is effectively elongated.

As a modification of the above preferred embodiments, first and second partial address electrodes A1 and A2 may be arranged so as to cross over only metal film 42 of second sustain electrodes Yn & Yn+1 nearest to border line DL. In this arrangement, clearance D between first and second partial address electrodes A1 and A2 becomes further longer.

Thus, according to the present invention the interference between adjacent partial screens can be prevented.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications and equivalents may be resorted to, falling within the scope of the invention.

What is claimed is:

1. A method of driving a surface-discharge plasma display panel having a display screen comprising a matrix of lines and rows of discharge cells defined by corresponding intersections of plural pairs of sustain electrodes and plural address electrodes, respectively, a border in the line direction dividing the display screen into first and second partial screens, dividing the address electrodes into respective first and second partial address electrodes aligned in the row direction and separated at adjacent, respective ends thereof and dividing the plural pairs of sustain electrodes into first and second groups respectively in the first second partial screens, each pair comprising first and second sustain electrodes and each subfield comprising at least an address period and a subsequent sustian period, the method comprising:

reversing an order of the first and second sustain electrodes of the plural pairs thereof in the first partial screen relatively to an order of the plural pairs thereof in the second partial screen;

performing a full screen reset, at least for each field, by producing discharges in all discharge cells of all lines;

during the address period, performing line-sequential addressing of the corresponding respective lines of the first and second partial screens, concurrently, by applying a scanning pulse sequentially to the second sustain electrodes for the plural lines of the first and second partial screens and, concurrently with the selection of a line of each of the first and second partial screens, applying address pulses to specific first and second partial address electrodes associated with respective discharge cells of the first and second partial screens in accordance with display data, to produce a discharge between the second sustain electrode of the selected line and the specific first and second partial address electrodes associated with the respective discharge cells of the first and second partial screens; and during the sustain period, concurrently for the first and second partial screens, applying sustain pulses to the first sustain electrodes and second sustain electrodes thereby to produce surface discharges in each of the discharge cells in which wall charges were accumulated during the address period.

2. A method as recited in claim 1, wherein the subfields are selectable so as to appropriately weight the brightness of the single field.

3. A method as recited in claim 1, wherein the subfields are each of a certain gradation level.

4. A method as recited in claim 3, comprising:

deviating the timing of the line selection of the last line of the first split screen adjacent the first clearance, and of the first line of the second split screen adjacent to the first clearance, to avoid interference of discharges between the adjacent lines.

5. A method of driving a surface-discharge plasma display panel having a display screen comprising a matrix of lines and rows of discharge cells defined by corresponding intersections of plural pairs of sustain electrodes and plural address electrodes, respectively, a border in the direction dividing the display screen into first and second partial screens, dividing the address electrodes into respective first and second partial address electrodes aligned in the row direction and separated at adjacent, respective ends thereof by a first clearance, and separating adjacent sustain electrode pairs, respectively of the first and second partial screens, by a second clearance substantially less than the first clearance, wherein each display field comprises plural subfields and each subfield comprising at least an address period and a subsequent sustain period, the method comprising:

performing a full screen reset, at least for each field, by producing discharges in all discharge cells of all lines;

during the address period, performing line-sequential addressing of the corresponding respective lines of the first and second partial screens, concurrently, by applying a scanning pulse sequentially to the second sustain electrodes concurrently for the respective plural lines of the first and second partial screens and, concurrently with the selection of a line of each of the first and second partial screens, applying address pulses to specific first and second partial address electrodes associated with respective discharge cells of the first and second partial screens in accordance with display data, to produce a discharge between a sustain electrode of the selected line and the specific first and second partial address electrodes associated with the respective discharge cells of the first and second partial screens; and during the sustain period, concurrently for the first and second partial screens, applying sustain pulses to the plural pairs of sustain electrodes.

6. A method as recited in claim 5, comprising:

deviating the timing of the line selection of the last line of the first split screen adjacent the first clearance, and of the first line of the second split screen adjacent to ther first clearance, to avoid interference of discharge between the adjacent lines.

7. A method as recited in claim 5, wherein the subfields are selectable so as to appropriately weight the brightness of the single field.

8. A method as recited in claim 5, wherein the subfields are each of a certain gradation level.

9. A method as recited in claim 5, wherein an order of the first and second partial sustain electrodes of the plural pairs thereof in the first partial screen is the same as an order of the plural pairs thereof in the second partial screen.

10. A method as recited in claim 5, wherein an order of the first and second partial sustain electrodes of the plural pairs thereof in the first partial screen is the same as an order of the plural pairs thereof in the second partial screen.

11. A method as recited in claim 5, comprising:

deviating the timing of the line selection of the last line of the first split screen adjacent the first clearance, and of the first line of the second split screen adjacent to the first clearance, to avoid interference of discharges between the adjacent lines.

12. A method of driving a surface-discharge plasma display panel having a display screen comprising a matrix of lines and rows of discharge cells defined by corresponding intersections of plural pairs of sustain electrodes and plural address electrodes, respectively, a border in the line direction dividing the display screen into first and second partial screens, dividing the address electrodes into respective first and second partial address electrodes aligned in the row direction and separated at adjacent, respective ends thereof and dividing the plural pairs of sustain electrodes into first and second groups respectively in the first and second partial screens, each pair comprising first and second sustain electrodes and each subfield comprising at least an address period and a subsequent sustain period, the method comprising:

arranging the locations of the first and second partial address electrodes, relative to the locations of the main electrode pairs, so as to prevent discharges between respective electrodes of the first and second partial screens during each of successive address and sustain periods;

during the address period, performing line-sequential addressing of the corresponding respective lines of the first and second partial screens and, concurrently with the selection of a line of each of the first and second partial screens, applying address pulses to specific first and second partial address electrodes in accordance with display data to produce corresponding discharges in relation to respective discharge cells; and during the sustain period, concurrently for the first and second partial screens, applying sustain pulses to the first sustain electrodes and second sustain electrodes.

13. A method as recited in claim 12, further comprising arranging the first and second partial address electrodes with a first clearance of a first distance in the row direction which is greater than a second clearance of a second distance in the row direction between adjacent main electrode pairs, respectively of the first and second partial screens.

14. A method as recited in claim 12, further comprising arranging the first and second sustain electrodes of the main electrode pairs of the first partial screen in a first order from a ton of the first partial screen and along the first partial address electrodes in the first partial screen to the border line and in a second order, opposite the first order, from the border line and along the second partial electrodes in the second partial screen to a bottom of the second partial screen.

15. A method of producing a surface-discharge type plasma display panel having a matrix display formation of lines and rows, comprising:

forming a plurality of main electrode pairs, each pair comprising first and second sustain electrodes, on a first substrate and extending along a line direction, including arranging the first and second sustain electrodes in parallel and adjacent to each other;

arranging a plurality of address electrodes, each extending along a row direction, on a second substrate, to be positioned opposing the first substrate via a discharge space;

forming a matrix of said main electrodes and said address electrodes, corresponding to a screen to be displayed, and crossing said address electrodes over said main electrodes; and dividing each of said address electrodes into two partial address electrodes, separated from each other by a border line located between adjacent main electrode pairs, thereby dividing said screen into first and second partial screens, and arranging said first and second sustain electrodes of the plural pairs thereof in the first partial screen in an order, along the row direction, which is a reverse of an order thereof in the second partial screen.

16. A method of producing a surface-discharge type plasma display panel as recited in claim 14, further comprising:

in said first partial screen, alternately arranging second and first sustain electrodes Y and X from a to of the first partial screen to the border line in the order of YX, YX, . . . ; and in said second partial screen, alternately arranging first and second electrodes X and Y from the border line to a bottom of the second partial screen in the order of XY,XY, . . . .

17. A method of producing surface-discharge type plasma display panel recited in claim 16, wherein each of said second sustain electrodes Y in each partial screen is separately supplied with a scanning pulse for sequentially selecting the line of the each partial screen in an address period.

18. A method of producing surface-discharge type plasma display panel, comprising:

arranging plural pairs of first and second, parallel and adjacent sustain electrodes so as to extend along a line direction and plural parallel and adjacent address electrodes, so as to extend along a row direction, and so as to be separated from the sustain electrodes by a discharge space;

separating respective, adjacent ends of at least first and second partial address electrodes of the address electrodes, aligned in the row direction, by a first clearance of a first distance in the row direction, dividing the screen into corresponding, at least first and second partial screens;

arranging the first and second sustain electrodes of the plural pairs thereof in the first partial screen in an order which is a reverse of an order thereof in the second partial screen; and selecting the first and second distances so as to prevent a discharge between respective electrodes of the first and second partial screens.

19. A method of producing a surface-discharge type plasma display panel as recited in claim 18, further comprising aligning the first and second clearances symmetrically on a common border line between the first and second partial screens.

20. A method of producing surface-discharge type plasma display panel as recited in claim 19, further comprising:

disposing a separator wall serving to prevent interference discharges between the first and second partial screens in alignment with the border line and extending substantially an entire length of each line of the display screen.

21. A method of producing surface-discharge type plasma display panel as recited in claim 20, further comprising forming the separate wall of a height substantially equal to a height of the discharge space.

22. A method of producing surface-discharge type plasma display panel as recited in claim 21, further comprising:

positioning the address electrodes so as to cross the plural pairs of sustain electrodes at intersecting locations defining corresponding discharge cells.

23. A method of producing surface-discharge type plasma display panel as recited in claim 20, further comprising positioning the respective, adjacent and separated ends of the address electrodes, separated from each other by the first clearance, so as not to cross the respective sustain electrodes, of the adjacent pairs of first and second system electrodes, separated by the second clearance of the second distance.

24. A method of producing surface-discharge type plasma display panel as recited in claim 23, further comprising positioning the respective, adjacent and separated ends of the address electrodes, separated from each other by the first clearance, so as not to cross the respective sustain electrodes, of the adjacent pairs of first and second sustain electrodes, separated by the second clearance of the second distance.

* * * * *

UNITED STATES PATENT AND TRADEMARK OFFICE

CERTIFICATE OF CORRECTION

PATENT NO. : 7,027,012 B2
APPLICATION NO. : 10/453488
DATED : April 11, 2006
INVENTOR(S) : Seiki Kuroki et al.

It is certified that error appears in the above-identified patent and that said Letters Patent is hereby corrected as shown below:

On the cover page, Title (54), after "PLASMA" insert --DISPLAY--

Column 7, line 36, after "first" insert --and--

Column 7, line 39, change "sustian" to --sustain--

Column 8, line 16, after "in the" insert --line--

Column 8, line 50, change "ther" to --the--

Column 8, line 51, change "discharge" to --discharges--

Column 8, line 64, change "the same as" to --a reverse of--

Column 9, line 3, change "split" to --partial--

Column 9, line 4, change "split" to --partial--

Column 9, line 49, change "ton" to --top--

Column 10, line 18, change "to" to --top--

Signed and Sealed this

Third Day of October, 2006

JON W. DUDAS
*Director of the United States Patent and Trademark Office*